US005424162A

United States Patent [19]

Kohri et al.

[11] Patent Number: 5,424,162

[45] Date of Patent: Jun. 13, 1995

[54] TONER FOR ELECTROPHOTOGRAPHY CONTAINING WAX-PARTICLES DISPERSED IN BINDER RESIN

[75] Inventors: Toshitaro Kohri, Higashiosaka; Hitoshi Kato, Itami; Hiroyuki Fukuda, Kobe, all of Japan

[73] Assignee: Minolta Camera Kabushiki Kaisha, Osaka, Japan

[21] Appl. No.: 155,653

[22] Filed: Nov. 22, 1993

[30] Foreign Application Priority Data

Nov. 24, 1992 [JP] Japan ..... 4-313205
Nov. 24, 1992 [JP] Japan ..... 4-313208
Nov. 24, 1992 [JP] Japan ..... 4-313209

[51] Int. Cl.[6] ..... G03G 9/097
[52] U.S. Cl. ..... 430/110; 430/111
[58] Field of Search ..... 430/106, 109, 110, 111

[56] References Cited

U.S. PATENT DOCUMENTS 4,386,147 5/1983 Seimiya et al. ..... 430/99
4,486,524 12/1984 Fujisaki et al. ..... 430/109
4,828,955 5/1989 Kasai et al. ..... 430/111
4,917,982 4/1990 Tomono et al. ..... 430/109
4,921,771 5/1990 Tomono et al. ..... 430/110
4,988,598 1/1991 Tomono et al. ..... 430/109
4,997,739 3/1991 Tomono et al. ..... 430/110
5,004,666 4/1991 Tomono et al. ..... 430/110
5,023,158 6/1991 Tomono et al. ..... 430/99
5,283,149 2/1994 Tyagi et al. ..... 430/106
5,320,926 6/1994 Ueda et al. ..... 430/110

*Primary Examiner*—John Goodrow
*Attorney, Agent, or Firm*—Willian Brinks Hofer Gilson & Lione

[57] ABSTRACT

The present invention related to a toner for electrophotography comprising at least a binder resin, a coloring agent and a wax for off-set prevention, in which the wax is incompatible with the resin, dispersed insularly in the resin in the form of substantially spherical and/or substantially spindle-shaped particles, the number of spindle-shaped wax-particles occupying 70% or less of the total number of wax-particles. The spherical wax-particles have a following relationship between a mean wax-particle size (Dw) and a mean toner-particle size (Dt):

$$0.05Dt \leqq Dw \leqq 0.2Dt$$

and the spindle-shaped wax-particles have a following relationship between a mean major axis (a), a mean minor axis (b) and a mean toner-particle size (Dt):

$$0.025Dt \leqq (ab^2)^{\frac{1}{3}} \leqq 0.1Dt.$$

19 Claims, 1 Drawing Sheet

TONER FOR ELECTROPHOTOGRAPHY CONTAINING WAX-PARTICLES DISPERSED IN BINDER RESIN

BACKGROUND OF THE INVENTION

1. Field of the invention

The present invention relates to a toner for electrophotography.

2. Description of the prior art

In general a toner for electrophotography is prepared as follows: a binder resin, a coloring agent and a desired additive are mixed and kneaded, and then the kneaded material is pulverized and classified.

A wax incompatible with the binder resin is generally added as one desired additive in order to prevent an off-set phenomenon at high temperature at the time of toner fixing by a heat-roller.

However, as the added wax is incompatible with the binder resin, it is difficult to disperse the wax in the form of small particles in the binder resin uniformly. Wax is liable to separate out from toner particles at the time of pulverization in toner-manufacturing process.

If a size of wax-particles separated out from toner particles is much smaller than a toner particle size, the wax-particles are removed in a classifying process. Even if the wax-particles are not removed, they adhere to toner particles, undergo the same processes as the toner particles and so do not influence adversely on a photosensitive member and copy images. If a size of wax-particles is almost the same as a toner particle size, wax-particles are not removed in a classifying process and they are incorporated into a final toner product.

As such separated wax-particles as incorporated into a final toner product do not contain a coloring agent and a charge controlling agent, they display chargeability completely different from that of the final toner product.

Wax-particles adhered to electrostatic latent images together with toner particles are not transferred onto copy paper even in a transferring process. They remain adhered to a photosensitive member.

These wax-particles remaining adhered to the photosensitive member are not cleaned by a cleaning blade in a cleaning process. The wax-particles fuse and stick to the photosensitive member. They are further spread thinly to form films on the photosensitive member, and to make matters worse, toner particles adhere to film-like wax to form lines of black spots on the photosensitive member.

As electrical charges do not leak from those films and black spots, fogs may be formed in copy images. When toner-particles are developed onto those films, the toner particles are transferred onto copy paper to cause image noises.

Recently, toner particle size is made small in order to elevate fineness of copy images. In the case of such small toner-particles, fine wax-particles need to be dispersed uniformly.

SUMMARY OF THE INVENTION

The object of the present invention is to provide a toner in which fine wax-particles are dispersed uniformly. The wax-particles do not separate out from toner not to cause a filming phenomenon on a photosensitive member, so that black spots and fogs are not formed.

The present invention relates to a toner for electrophotography comprising at least a binder resin, a coloring agent and a wax for off-set prevention, in which the wax is incompatible with the resin, dispersed insularly in the resin in the form of substantially spherical and/or substantially spindle-shaped particles, the number of the substantially spindle-shaped wax-particles occupying 70% or less of the total number of wax-particles. The spherical wax-particles have a following relationship between a mean wax-particle size (Dw) and a mean toner-particle size (Dt):

$$0.05Dt \leqq Dw \leqq 0.2Dt$$

and the substantially spindle-shaped wax-particles have a following relationship between a mean major axis (a), a mean minor axis (b) and a mean toner-particle size (Dt):

$$0.025Dt \leqq (ab^2)^{\frac{1}{3}} \leqq 0.1Dt.$$

DETAILED DESCRIPTION OF THE INVENTION

Figure 1:
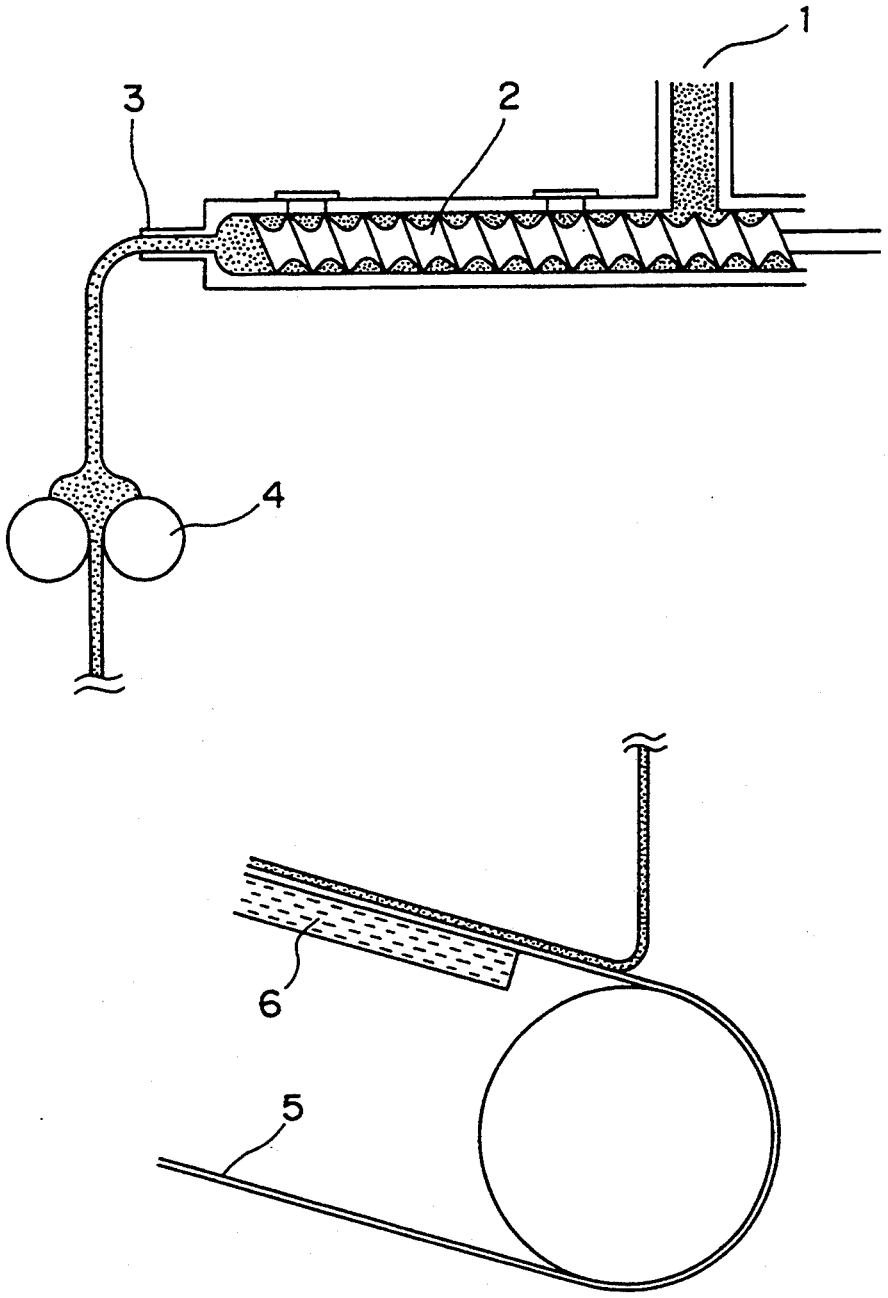
FIG. 1 is a schematic representation of a continuous extruder (PCM30; made by Ikegu Tekko K. K.).

A toner for electrophotography of the present invention comprises a binder resin, a coloring agent and a wax incompatible with the binder resin.

The binder resin used in the present invention may be a thermoplastic resin which has been conventionally used, such as styrene-acrylic copolymers and polyesters. It is more desirable to use a resin having a softening point of 80°–160° C., preferably 90°–150° C., more preferably 100°–140° C.

The wax used in the present invention is not particularly limitative so far as it is incompatible with the thermoplastic resin used as the binder resin. It is more desirable to use a wax having a melting point of 90°–180° C., preferably 100°–170° C., more preferably 110°–160°C. The preferable wax is a paraffinic wax, such as polypropylene of low molecular weight, polyethylene of low molecular weight, ethylene-bis-amide, microcrystalline wax, carnauba wax and beeswax.

The wording 'incompatible' in the present invention means that when a wax is fused and kneaded with a resin, the wax is dispersed insularly in the resin and not taken into molecular chains of resin.

The wax is dispersed in a binder resin in the form of substantially spherical and/or substantially spindle-shaped particles in the present invention.

The wording 'substantially spherical' means that a ratio (a/b) of a major axis (a) to a minor axis (b) is within the range between 1/1 and 3/1. A mean wax-particle size (Dw) is calculated from the following formula:

$$Dw=(a+b)/2$$

When such substantially spherical wax-particles are dispersed in a resin, a mean wax size is small and the following relationship is met between a mean wax-particle size (Dw) and a mean toner-particle size (Dt):

$$0.05Dt \leqq Dw \leqq 0.2Dt$$

The wording 'substantially spindle-shaped' means that a ratio (a/b) of a mean major axis (a) to a mean minor axis (b) calculated from wax-particles other than the substantially spherical wax-particles is within the range between 5/1 and 20/1. If the major axis is much longer than the minor axis, free wax-particles are liable to be incorporated into a final toner product. But when the ratio a/b is within the range between 1/1 and 3/1, it is substantially spherical. In this case, it is necessary that Dw and Dt meets the relationship as above mentioned.

When the substantially spindle-shaped wax-particles as above mentioned are dispersed in a resin, they are dispersed in such a way that a mean major axis (a), a mean minor axis (b) and a mean toner-particle size (Dt) have the following relationship:

$$0.025Dt \leqq (ab^2)^{\frac{1}{3}} \leqq 0.1Dt.$$

The term $(ab^2)^{\frac{1}{3}}$ is obtained statistically based on the experimental results and shows approximately a radius of spindle-shaped wax.

If Dw is smaller than 0.05 Dt or if $(ab^2)^{\frac{1}{3}}$ is smaller than 0.025 Dt, an off-set phenomenon at high temperature can not be prevented satisfactorily. Further it becomes difficult to remove free wax-particles because the free wax-particles adhere to a final toner product even after classification. If Dw is larger than 0.2 Dt or if $(ab^2)^{\frac{1}{3}}$ is larger than 0.1 Dt, free wax-particles are taken into a final toner product to cause a filming phenomenon and a black spot.

A mean wax-particle size, a length of major axis and minor axis are respectively an average value obtained as follows: a resultant toner is treated with a solvent which can dissolve a binder resin of toner but can not dissolve a wax. The obtained solution is subjected to a centrifuge separation treatment. Wax-particles floating on the solvent are collected and observed by a scanning electron microscope (SEM). About five hundred substantially spherical and spindle-shaped particles are optionally selected from a region (7.3×9.5 cm in a 1000-times magnified photograph).

A mean toner-particle size is a mean volume size measured by Coulter counter.

Substantially spindle-shaped and spherical wax-particles are dispersed at random. However this is not a particular matter so far as Dw and $(ab^2)^{\frac{1}{3}}$ meet a relationship as above mentioned.

It is desirable in the present invention that the number of substantially spindle-shaped wax-particles occupies 70% or less, preferably 60% or less, more preferably 50% or less of the total number of wax-particles.

A toner of the present invention is prepared by mixing a binder resin, a coloring agent, a wax, a charge controlling agent and other additives, followed by kneading, pulverizing, classifying. The wax is added at a content of 1–7 parts by weight, preferably 2–6 parts by weight on the basis of 100 parts by weight of the binder resin. If the content is smaller than 1 part by weight, an off-set phenomenon at high temperature can not be prevented satisfactorily. If the content is larger than 7 parts by weight, many free wax-particles are formed to cause often filming phenomena and many black spots. The other additives may be added at a conventional content.

Uniform dispersion of fine wax-particles can be achieved as follows: in a mixing process a mixing machine which has a grinding ability, such as a ball mill and Henschel mixer, is used, and in a kneading process a mixture obtained in the mixing process is kneaded at a temperature lower than a melting point of the binder resin so as to utilize a shearing stress of the resin. It is preferable to knead the mixture at a temperature as low as possible.

In more detail, it is desirable to prepare a toner of the present invention according to a production method comprising;

mixing at least a thermoplastic resin with a wax, kneading the above mixture at a preset temperature (Ts) of a kneader between (Tm minus 20° C.) and (Tm plus 20° C.) (in which Tm means a melting point of the thermoplastic resin) with an outlet temperature of the kneaded material set at (Tm+35° C.) or less, and cooling, pulverizing and classifying the kneaded material.

In the production method of such a toner of the present invention, a wax is mixed together with a thermoplastic resin. The thermoplastic resin may be in advance pulverized (pre-pulverized). A bulk of the resin may be pulverized with mixing.

When pre-pulverized resin particles are used, it is preferable to adjust a mean particle size of the resin particles to fall in the range between 100 and 5000 μm, preferably between 500 and 2000 μm by a suitable means, such as a screen. Such a particle size range is required from the viewpoint that a coloring agent, a charge controlling agent and a wax are mixed and dispersed uniformly.

When a mixing process is carried out by use of a mixer which can provide a shearing force for raw materials, it is necessary to adjust a mean particle size as above mentioned. Further it is desirable to mix raw materials under such conditions that a temperature of the mixed raw materials increases at a rate between 3° C. and 20° C. and the difference of mean particle size before and after mixing is within the range between 300 and 800 μm. If a rate of heat build-up is high, heat is accumulated and raw materials aggregate. If a rate of heat build-up is low, raw materials are mixed and dispersed insufficiently. If the difference of mean particle size before and after mixing is large, heat generates so much in the machine. If the difference of mean particle size before and after mixing is low, it becomes difficult to disperse raw materials effectively, and a sufficient amount of raw materials can not be taken into a screw of a kneader. Production efficiency is influenced adversely.

In the next step, a mixture prepared in the mixing process is melt and kneaded (referred to as a melting and kneading process hereinafter).

A kneader, such as a biaxial continuous extrusion kneader, a press kneader and a three-roll kneader, may be used. The kneading process is carried out at a preset temperature (Ts) of a kneader between (Tm minus 20° C.) and (Tm plus 20° C.) (in which Tm means a melting point of a thermoplastic resin) with an outlet temperature of the kneaded material set at (Tm plus 35° C.) or less.

If a preset temperature is lower than (Tm minus 20° C.), resin and wax do not melt enough. A kneader is overloaded. Kneading can not be performed. In addition, as resin does not melt enough, fusion-bonding function of resin is displayed not so well that an additive, such as a pigment, is separated out to cause a filming phenomenon. If a preset temperature is higher than (Tm plus 20° C.), a mixture is melt and kneaded under conditions of no shearing force. A wax, a charge controlling agent, a pigment and other additives are not dispersed sufficiently to cause a filming phenomenon, black spots and fogs.

The reason why the outlet temperature of the kneaded material is set at (Tm plus 35° C.) or less is that if the outlet temperature is higher (Tm plus 35° C.), the same problems as in the case where a preset temperature (Ts) is higher than (Tm plus 20° C.), i.e. a filming phenomenon, black spots and fogs, are brought about.

Finally a kneaded material given in the above melting and kneading process is cooled, pulverized and classified (referred to as a pulverizing and classifying process hereinafter).

The kneaded material obtained in the melting and kneading process may be cooled naturally on a pad. Alternatively it may be cooled forcibly with being pressed after taken into a press roller. When the kneaded material is cooled forcibly, in particular, with a certain pressure, the melted and kneaded material given from the kneader should be neither cooled rapidly nor stretched until it is cooled to Tm minus 20° C. It is preferable to be cooled slowly to that temperature. Rapid cooling and stretching cause problems, such as insufficient dispersion of wax, big wax-particles, dispersion of rice-shaped wax-particles and dispersion of leaf-shaped wax-particles, resulting in black spots on a photosensitive member and a filming phenomenon.

When the kneaded material is pressed and stretched by a roller to have a plate-like shape, it is desirable to be formed to have a thickness between 1 and 5 mm, preferably between 1 and 3 mm. If the plate is thicker than 5 mm, it can not be cooled in a short time and spindle-shaped wax-particles are liable to be formed because it is stretched even after delivered from a press roller. If the plate is thinner than 1 mm, spindle-shaped wax-particles are liable to be formed when the kneaded material is pressed and stretched by a press roller.

After the kneaded material is cooled, it is pulverized and classified according to a conventional method to give toner particles having a mean particle size between 3 and 15 μm, preferably between 3 and 9 μm, more preferably between 3 and 7 μm. The present invention is remarkably effective to small toner particles having a mean particle size between 3 and 9 μm, in particular between 3 and 7 μm.

In toner particles as above obtained, spherical wax-particles having a mean particle size between 0.2 and 3.0 μm, particularly between 0.4 and 1.1 μm and/or spindle-shaped wax-particles having a major axis of between 1.0 and 4.0, particularly 1.8 and 3.2 μm are dispersed uniformly.

The present invention is further exemplified by examples.

EXAMPLE 1

| ingredient | part by weight |
|---|---|
| styrene-acrylic copolymer resin (number-average molecular weight (Mn): 4500, Mw/Mn:48 (Mw means weight-average molecular weight), glass transition point (Tg):62° C.) | 100 |
| carbon black (MA#8; made by Mitsubishi Kasei Logyo K.K.) | 8 |
| nigrosine dye (BontronN-01; made by Orient Kagaku Kogyo K.K.) | 3 |
| polypropylene of mow molecular weight (Biscol 550P; made by Sanyo Kasei Kogyo) | 4 |

The above ingredients were put into a ball mill, mixed and pulverized for 24 hours. Further they were kneaded in a three roll mill for 15 minutes. At this time, the back roll and the middle roll were set at 140° C. and the front roll was set at 120° C.

The kneaded material was taken out from the mill, cooled slowly to 90° C. and further cooled by cold air to 40° C. or less. The cooled material was pulverized coarsely to give 2 mm or less fragments.

Then the coarsely pulverized material was pulverized finely in a jet mill to have a mean particle size of 8.4 μm. Coarse particles and fine particles were removed by a DS classifier to give particles having a mean particle size of 9.1 μm.

Hydrophobic silica (H-2000; made by Hext K. K.) was added for surface-treatment to the above obtained particles at a content of 0.2% by weight. Thus Toner A was obtained.

EXAMPLE 2

| ingredient | part by weight |
|---|---|
| polyester resin (number-average molecular weight (Mn):6800, Mw/Mn:32 (Mw means weight-average molecular weight), glass transition point (Tg):65° C.) | 100 |
| carbon black (MA#44; made by Mitsubishi Kasei Kogyo K.K.) | 8 |
| oil-soluble dye containing Cr metal (BontronS-34; made by Orient Kagaku Kogyo K.K.) | 2 |
| polypropylene of low molecular weight (Biscol TS-200; made by Sanyo Kasei Kogyo) | 4 |

The above ingredients were treated in a manner similar to that of EXAMPLE 1 to give Toner B having a mean particle size of 8.2 μm.

EXAMPLES 3–5

Toners C, D and E were prepared in a manner similar to that of EXAMPLE 1 except for an amount of the surface treating agent as shown in Table 1 below.

TABLE 1

| | Particle Size (μm) | Surface Treatment |
|---|---|---|
| Toner C | 5.4 μm | H-2000 0.3 wt % |
| Toner D | 12.1 μm | H-2000 0.15 wt % |
| Toner E | 14.8 μm | H-2000 0.1 wt % |

EXAMPLE 6

Toner F having a mean particle size of 8.4 μm was prepared in a manner similar to that of EXAMPLE 1 except that Biscol 660P was used as polypropylene of low molecular weight.

EXAMPLE 7

Toners G, H and I were prepared in a manner similar to that of EXAMPLE 1 except for an amount of polypropylene of low molecular weight as shown in Table 2 below.

TABLE 2

| | polypropylene of low molecular weight | Particle size |
|---|---|---|
| Toner G | 1 part by weight | 8.7 μm |
| Toner H | 5 parts by weight | 9.2 μm |
| Toner I | 7 parts by weight | 8.6 μm |

COMPARATIVE EXAMPLE 1

The same ingredients as those in EXAMPLE 1 were put in a V-blender at the same composition ratio as that in EXAMPLE 1. The V-blender was rotated for 15 minutes to mix the ingredients uniformly.

Then the mixture was put in a continuous extrusion kneader and kneaded at a preset temperature of 160° C. A temperature of the kneaded material delivered from the kneader was 178° C. After the resultant kneaded material was cooled rapidly on a cooling belt to 40° C. or less, it was pulverized coarsely to give 2 mm or less fragments.

Then, the coarsely pulverized material was finely pulverized in a jet grinder and further classified by a DS classifier to give particles having a mean particle size of 8.6 μm. Hydrophobic silica (H-2000) was added to the obtained particles at a content of 0.2% by weight. Thus Toner J was obtained.

COMPARATIVE EXAMPLE 2

The same ingredients as those in EXAMPLE 2 were used at the same composition ratio as that in EXAMPLE 2 to prepare Toner K having a particle size of 8.5 μm in a manner similar to that of COMPARATIVE EXAMPLE 1.

COMPARATIVE EXAMPLE 3

The same ingredients as those in EXAMPLE 3 were used at the same composition ratio as that in EXAMPLE 3 except that 8 parts by weight of polypropylene of low molecular weight were used. Thus Toner L having a particle size of 8.8 μm was obtained.

COMPARATIVE EXAMPLE 4

Four parts by weight of polypropylene of low molecular weight (Biscol 330P; made by Sanyo Kasei Kogyo K. K.) were added, melted and dispersed at the time of styrene-acrylic copolymer being prepared by solution polymerization.

Then, the solvent was removed from the melted material under high vacuum to give resin.

The obtained resin had a number average molecular weight of 5,200, a degree of dispersion (Mw/Mn) of 46 and a glass transition point of 61° C.

| ingredient | part by weight |
|---|---|
| the above resin | 100 |
| carbon black (MA#8; made by Mitsubishi Kasei Kogyo K.K.) | 8 |
| nigrosine dye (BontronN-01; made by Orient Kagaku Kogyo K.K.) | 3 |

The above ingredients were used to prepare Toner M having a mean particle size of 8.4 μm in a manner similar to that in EXAMPLE 1.

Toners A–M prepared in EXAMPLES and COMPARATIVE EXAMPLES were dissolved in chloroform and subjected to a centrifuging treatment. After 10 minutes, wax-particles which were floating on the surface were collected. A photograph of the wax-particles was taken by a scanning electron microscope. Wax-particle sizes were measured. The results are shown in Table 3.

TABLE 3

| toner | toner particle size(μm) | addition of wax (pbw) | particle size of toner spherical spindle-shaped Dw(μm) | a([2m) | b(μm) | $(ab^2)^{\frac{1}{3}}$ |
|---|---|---|---|---|---|---|
| A | 9.1 | 4 | 0.6 | 2.2 | 0.3 | 0.58 |
| B | 8.2 | 3 | 0.6 | 2.0 | 0.3 | 0.56 |
| C | 5.4 | 4 | 0.4 | 1.6 | 0.2 | 0.4 |
| D | 12.1 | 4 | 1.1 | 3.2 | 0.4 | 0.8 |
| E | 14.8 | 4 | 2.2 | 3.6 | 0.5 | 0.97 |
| F | 8.4 | 4 | 0.6 | 1.9 | 0.2 | 0.44 |
| G | 8.7 | 1 | 0.5 | 1.8 | 0.3 | 0.55 |
| H | 9.2 | 5 | 0.9 | 2.4 | 0.3 | 0.6 |
| I | 8.6 | 7 | 1.2 | 3.0 | 0.4 | 0.78 |
| J | 8.6 | 4 | 2.0 | 3.1 | 0.8 | 1.26 |
| K | 8.5 | 3 | 1.9 | 3.0 | 0.8 | 1.24 |
| L | 8.8 | 8 | 2.5 | 3.5 | 0.9 | 1.42 |
| M | 8.4 | 4 | 0.3 | 2.2 | 0.1 | 0.28 |

Negatively chargeable Toners were put in a copying machine EP8600 (made by Minolta Camera K. K.). Positively chargeable Toners were put in a copying machine EP8600 which was remodeled by use of an organic photosensitive member of a laminated type. Toners A–M were respectively mixed with a carrier of binder type (mean particle size of 62 μm) which had been prepared separately to charge the Toners electrically. Then a durability test with respect to copy was carried out. The results are shown in Table 4 below.

Further, fixing properties were evaluated. In this case, a system speed was preset at 13 cm/sec and images having image-density (I.D.) of 1.2 and 0.6 were copied respectively. Copy images were rubbed three times in a double stroke with a sand eraser under 1 kg load. A ratio (%) of image density of erased copy images to the initial image density was calculated. Off-set generation temperature at high temperature was also measured. The results are shown in Table 5.

TABLE 4

| toner | initial charge amount (μC/g) | after repetition of 300K times charge amount (μC/g) | filming on photosensitive member | black spot |
|---|---|---|---|---|
| A | 15.3 | 14.9 | ◎ | ○ |
| B | −16.7 | −16.0 | ◎ | ○ |
| C | 18.9 | 17.8 | ○ | ○ |
| D | −13.1 | 12.4 | ◎ | ○ |
| E | 12.1 | 11.0 | ○ | ○ |
| F | 16.4 | 16.3 | ◎ | ○ |
| G | 17.2 | 16.8 | ◎ | ○ |
| H | 15.8 | 14.9 | ◎ | ○ |
| I | 16.6 | 15.0 | ○ | Δ |
| J | 17.2 | 14.2 | x | x |
| K | −16.8 | −12.9 | x | x |
| L | 15.9 | 11.3 | x | x |
| M | 16.2 | 10.8 | x | ○ |

The evaluation was ranked as follows:

Filming On Photosensitive Member

◎: No filming phenomenon was observed.

○: A filming phenomenon was observed a little, but there was no problem in practical use.

x: A filming phenomena and fogs were observed.

Black Spots (BS)

○: No black spot was observed.

Δ: Black spots were observed on a photosensitive member, but they were not observed in copy images.

x: Black spots were observed in copy images.

TABLE 5

| Toner | ID1.2 (%) | ID0.6 (%) | off-set temp. at high temp. |
|---|---|---|---|
| A | 92 | 84 | 240° C. or more |
| B | 88 | 73 | 240° C. or more |
| C | 90 | 82 | 240° C. or more |
| D | 93 | 84 | 240° C. or more |
| E | 94 | 84 | 240° C. or more |
| F | 95 | 87 | 240° C. or more |
| G | 86 | 72 | 232° C. or more |
| H | 94 | 84 | 240° C. or more |
| I | 95 | 86 | 240° C. or more |
| J | 89 | 74 | 240° C. or more |
| K | 90 | 78 | 240° C. or more |
| L | 93 | 83 | 240° C. or more |
| M | 87 | 70 | 215° C. or more |

At least 80% of the ratio of the image density is required practically with respect to the images of I.D. 1.2. At least of 65% of the ratio of the image density is required practically with respect to the images of I.D. of 0.6. At least 230° C. of off-set generation temperature at high temperature is required practically.

| ingredient | part by weight |
|---|---|
| styrene-acrylic copolymer resin (number-average molecular weight (Mn):4200, Mw/Mn:52 (Mw means weight-average molecular weight), glass transition point (Tg):61° C., melting point(Tm):125° C.) | 100 |
| carbon black (MA#8; made by Mitsubishi Kasei Kogyo K.K.) | 8 |
| nigrosine dye (BontronN-01; made by Orient Kagaku Kogyo K.K.) | 4 |
| polypropylene of low molecular weight (Biscol 550P; made by Sanyo Kasei Kogyo K.K.) | 4 |

A mean particle size of a mixture of the above ingredients was measured by means of a multi-stage shaking screen. It was 840 μm. This mixture was put in Henschel mixer and stirred at 2,000 rpm for 3 minutes. At this time, a temperature of the mixture increased from 25° C. to 46° C. After mixing, a mean particle size was 320 μm.

The mixture above obtained was kneaded in a biaxial extrusion kneader (PCM30) preset at 120° C. A temperature of the delivered resin was 151° C. The delivered resin bulk was cooled slowly to 93° C. and continuously cooled rapidly by cold air. The cooled material was pulverized coarsely.

The coarsely pulverized material was further pulverized by a jet grinder to have a mean particle size of 8.2 μm. Then coarse particles and fine particles were removed by a DS classifier to give toner particles having a mean particle size of 8.7 μm.

Hydrophobic silica (H-2000; made by Hext K. K.) was added for surface-treatment to the above obtained toner particles at a content of 0.2% by weight. Thus Toner N was obtained.

EXAMPLE 9

| ingredient | part by weight |
|---|---|
| polyester resin (number-average molecular weight (Mn):7,100, Mw/Mn:40 (Mw means weight-average molecular weight), glass transition point (Tg):66° C., melting point: 132° C.) | 100 |
| carbon black (Legal 330; made by Cabot K.K.) | 8 |
| oil-soluble dye containing Cr metal (BontronS-34; made by Orient Kagaku Kogyo K.K.) | 2 |
| polypropylene of low molecular weight (Biscol TS-200; made by Sanyo Kasei Kogyo) | 4 |

A mean particle size of a mixture of the above ingredients was measured by means of a multi-stage shaking screen. It was 1,040 μm. This mixture was put in Henschel mixer and stirred at 2,000 rpm for 3 minutes. At this time, a temperature of the mixture increased from 24° C. to 48° C. After mixing, a mean particle size was 550μm.

The mixture above obtained was kneaded in a biaxial extrusion kneader (PCM30) preset at 130° C. A temperature of the delivered resin was 162° C. The delivered resin bulk was cooled slowly to 98° C. and continuously cooled rapidly by cold air. The cooled material was pulverized coarsely.

The coarsely pulverized material was further pulverized by a jet grinder to have a mean particle size of 8.2 μm. Then coarse particles and fine particles were removed by a DS classifier to give toner particles having a mean particle size of 8.5 μm.

Hydrophobic silica (H-2000; made by Hext K. K.) was added for surface-treatment to the above obtained toner particles at a content of 0.2% by weight. Thus Toner ○ was obtained.

EXAMPLE 10

Toners P–U were prepared in a manner similar to that in EXAMPLE 8 or EXAMPLE 9 under the conditions shown below by use of the same ingredients that were used in EXAMPLE 8 or EXAMPLE 9.

TABLE 6

| toner | resin Tm | mean particle size before mixed (μm) | number of revolution (rpm) | time (min.) | mean particle size(μm) after mixed | temp. of mixture before mixed | temp. of mixture after mixed | preset temp. of kneader | temp. of delivered resin | temp. after cooled slowly | mean particle size |
|---|---|---|---|---|---|---|---|---|---|---|---|
| A | 125° C. | 840 | 2000 | 3 | 320 | 25° C. | 46° C. | 120° C. | 151° C. | 93° C. | 8.7 μm |
| B | 132° C. | 1040 | 2000 | 3 | 550 | 24° C. | 48° C. | 130° C. | 162° C. | 98° C. | 8.5 μm |
| C | 125° C. | 840 | 1000 | 1 | 580 | 24° C. | 26° C. | 120° C. | 159° C. | 96° C. | 8.4 μm |
| D | 125° C. | 840 | 1000 | 3 | 480 | 24° C. | 27° C. | 160° C. | 175° C. | 128° C. | 8.7 μm |
| E | 125° C. | 840 | 2000 | 3 | 320 | 25° C. | 46° C. | 130° C. | 164° C. | 112° C. | 8.8 μm |
| F | 111° C. | 1260 | 1500 | 4 | 370 | 24° C. | 47° C. | 100° C. | 149° C. | 90° C. | 7.9 μm |
| G | 111° C. | 1260 | 1500 | 4 | 370 | 24° C. | 47° C. | 135° C. | 148° C. | 90° C. | 7.8 μm |

TABLE 6-continued

| toner | resin Tm | mean particle size before mixed (μm) | number of revolution (rpm) | time (min.) | mean particle size(μm) after mixed | temp. of mixture before mixed | temp. of mixture after mixed | preset temp. of kneader | temp. of delivered resin | temp. after cooled slowly | mean particle size |
|---|---|---|---|---|---|---|---|---|---|---|---|
| H | 150° C. | 1310 | 2000 | 3 | 1060 | 26° C. | 49° C. | 155° C. | 186° C. | 141° C. | 9.2 μm |

Toners N–U prepared in EXAMPLES were dissolved respectively in chloroform and subjected to a centrifuging treatment. After 10 minutes, wax-particles which were floating on the surface were collected. A photograph of the wax-particles was taken by a scanning electron microscope. Wax-particle sizes were measured. The results are shown in Table 7 below.

TABLE 7

| toner | toner particle size(μm) | particle size of toner: spherical Dw(μm) | spindle-shaped a(μm) | spindle-shaped b(μm) | $\sqrt[3]{ab^2}$ |
|---|---|---|---|---|---|
| N | 8.7 | 0.7 | 2.0 | 0.3 | 0.56 |
| O | 8.5 | 0.8 | 2.1 | 0.3 | 0.57 |
| P | 8.4 | 2.1 | 3.2 | 0.9 | 1.37 |
| Q | 8.7 | 2.5 | 3.5 | 1.0 | 1.52 |
| R | 8.8 | 0.9 | 2.6 | 0.8 | 1.18 |
| S | 7.9 | 0.9 | 1.8 | 0.2 | 0.42 |
| T | 7.8 | 1.6 | 2.8 | 0.5 | 0.88 |
| U | 9.2 | 2.6 | 3.8 | 1.2 | 1.76 |

In Table 7, Dw represents a mean particle size of spherical wax-particles. The letter "a" represents a mean major axis of spindle-shaped wax-particles. The letter "b" represents a mean minor axis of spindle-shaped wax-particles.

Negatively chargeable Toners were put in a copying machine EP8600 (made by Minolta Camera K. K.). Positively chargeable Toners were put in a copying machine EP8600 which was remodeled by use of an organic photosensitive member of a laminated type. Toners N–U were respectively mixed with a carrier of binder type (mean particle size of 62 μm) which had been prepared separately to charge the Toners electrically. Then a durability test with respect to copy was carried out. The results are shown in Table 8 below.

TABLE 8

| toner | initial charge amount (μC/g) | after repetition of 300K times: charge amount (μC/g) | filming on photosensitive member | black spot |
|---|---|---|---|---|
| N | 18.2 | 17.4 | ◎ | ○ |
| 0 | −17.6 | −16.1 | ◎ | ○ |
| P | 17.7 | 12.7 | x | x |
| Q | 17.9 | 13.1 | x | x |
| R | 18.0 | 14.6 | x | x |
| S | 18.8 | 17.5 | ◎ | ○ |
| T | 18.1 | 16.2 | ○ | Δ |
| U | 17.2 | 14.9 | x | x |

EXAMPLE 11

| ingredient | part by weight |
|---|---|
| styrene-acrylic copolymer resin (number-average molecular weight (Mn):5,800, Mw/Mn:48 (Mw means weight-average molecular weight) | 100 |
| carbon black (MA#8; made by Mitsubishi Kasei Kogyo K.K.) | 7 |
| nigrosine dye (Nigrosine baseEX made by Orient Kagaku Kogoyo K.K.) | 3 |
| polypropylene of low molecular weight (Biscol 550P; made by Sanyo Kasei Kogoyo K.K.) | 3 |

The above ingredients were put in a ball mill for mixing and pulverizing them for 13 hours. FIG. 1 shows a schematic view of a continuous extrusion kneader (PCM30; made by Ikegu Tekko K. K.). The mixture was put in through a material-charging inlet (1) of the continuous extrusion kneader preset at 125° C. in a melting and kneading temperature. The charged material was melted and kneaded with revolving a screw (2) connected to a motor (not shown).

A kneaded material delivered from a material delivering outlet was led between cooling press rollers (3) and stretched to have 1 mm thickness. Continuously the stretched material was dropped onto a cooling belt made of steel and further cooled sufficiently by means of a cooling unit (6).

The cooled material was pulverized coarsely, pulverized finely and classified to give particles having a mean particle size of 8.8 μm.

Hydrophobic silica (H-2000; made by Hext K. K.) was added for surface-treatment to the above obtained particles at a content of 0.2% by weight. Thus Toner V was obtained.

EXAMPLE 12

The same ingredients as those in EXAMPLE 11 were used. Toner W having a mean particle size of 8.7 μm was prepared in a manner similar to that in EXAMPLE 11 except that a kneaded material was stretched between the cooling press rollers to have 2.8 mm thickness.

EXAMPLE 13

The same ingredients as those in EXAMPLE 11 were used. The ingredients were mixed, pulverized, kneaded and delivered from the continuous extrusion kneader (PCM30) in a manner similar to that in EXAMPLE 11. The delivered material was caught directly on a pan and cooled slowly. The cooled material was treated in a manner similar to that in EXAMPLE 11 to give Toner X having a mean particle size of 8.8 μm.

EXAMPLE 14

The same ingredients as those in EXAMPLE 11 were used. The ingredients were mixed, pulverized, kneaded and delivered from the continuous extrusion kneader (PCM30) in a manner similar to that in EXAMPLE 11. The delivered material was dropped into water directly and cooled rapidly. The cooled material was taken out from water and dried. Then the obtained material was treated in a manner similar to that in EXAMPLE 11 to give Toner Y having a mean particle size of 8.9 μm.

Toners V–Y prepared in EXAMPLES were dissolved respectively in chloroform and subjected to a centrifuging treatment. After 10 minutes, wax-particles which were floating on the surface were collected. A photograph of the wax-particles was taken by a scanning electron microscope. Wax-particle sizes were measured. The results are shown in Table 9 below.

TABLE 9

| toner | toner particle size(μm) | shape of wax: spherical (%) | shape of wax: spindle-shaped (%) |
|---|---|---|---|
| V | 8.8 | 42 | 58 |
| W | 8.7 | 67 | 33 |
| X | 8.8 | 96 | 4 |
| Y | 8.9 | 99 | 1 |

Toners were put in a copying machine EP8600 which was remodeled by use of an organic photosensitive member of a laminated type. Toners V–Y were respectively mixed with a carrier of binder type (mean particle size of 65 μm) which had been prepared separately to charge the Toners electrically. Then durability tests with respect to copy (100K and 300K) were carried out respectively. The results are shown in Tables 10 and 11 below.

TABLE 10

| toner | initial charge amount (μC/g) | after repetition of 100K times: charge amount (μC/g) | filming on photosensitive member | black spot |
|---|---|---|---|---|
| V | 17.8 | 17.0 | ◎ | ∘ |
| W | 17.6 | 17.2 | ◎ | ∘ |
| X | 17.7 | 17.5 | ◎ | ∘ |
| Y | 17.4 | 17.3 | ◎ | ∘ |

TABLE 11

| toner | initial charge amount (μC/g) | after repetition of 300K times: charge amount (μC/g) | filming on photosensitive member | black spot |
|---|---|---|---|---|
| V | 17.8 | 16.8 | ∘ | ∘ |
| W | 17.6 | 17.0 | ∘ | ∘ |
| X | 17.7 | 17.4 | ◎ | ∘ |
| Y | 17.4 | 17.3 | ◎ | ∘ |

What is claimed is:

1. A toner for electrophotography comprising at least a binder resin, a coloring agent and a wax for off-set prevention, in which the wax is incompatible with the resin, dispersed insularly in the resin in the form of substantially spherical and/or substantially spindle-shaped particles, the spherical wax-particles have a following relationship between a mean wax-particle size (Dw) and a mean toner-particle size (Dt):

$$0.05DT \leqq Dw \leqq 0.2Dt$$

and the spindle-shaped wax-particles have a following relationship between a mean major axis (a), a mean minor axis (b) and a mean toner-particle size (Dt):

$$0.025Dt \leqq (ab^2)^{\frac{1}{3}} \leqq 0.1Dt.$$

2. A toner of claim 1, in which the substantially spherical wax-particles have a ratio (a/b) of a major axis (a) to a minor axis (b) within the range between 1/1 and 3/1.

3. A toner of claim 1, in which the substantially spindle-shaped wax-particles have a ratio (a/b) of a mean major axis (a) to a mean minor axis (b) within the range between 20/1 and 5/1.

4. A toner of claim 1, in which the wax is contained at an amount of 1–7 parts by weight on the basis of the binder resin of 100 parts by weight.

5. A toner of claim 1, having a mean toner-particle size between 3 and 15 μm.

6. A toner of claim 1, having a mean toner-particle size between 3 and 9 μm.

7. A toner of claim 1, in which the binder resin is a thermoplastic resin having a softening point between 80° and 160° C.

8. A toner of claim 1, in which the wax has a melting point between 90° and 180° C.

9. A toner for electrophotography containing at least a thermoplastic resin, a coloring agent and a wax for off-set prevention, which is prepared by;

mixing at least the thermoplastic resin of 100 parts by weight with the wax of 1–7 parts by weight, kneading the above mixture at a preset temperature (Ts) of a kneader between Tm minus 20° C. and Tm plus 20° C., wherein Tm means a melting point of the thermoplastic resin with an outlet temperature of the kneaded material set at Tm plus 35° C. or less, and cooling, pulverizing and classifying the kneaded material.

10. A toner of claim 9, in which the thermoplastic resin has a softening point between 80° and 160° C.

11. A toner of claim 9, in which the wax has a melting point between 90° and 180° C.

12. A toner of claim 9, in which the thermoplastic resin is pre-pulverized to have a mean particle size between 100 and 5000 μm.

13. A toner for electrophotography comprising at least a binder resin, a coloring agent and a wax for off-set prevention, in which the wax is incompatible with the resin, dispersed insularly in the resin in the form of substantially spherical and substantially spindle-shaped particles, the number of spindle-shaped wax-particles occupying 70% or less of the total number of wax-particles.

14. A toner of claim 13, in which the substantially spherical wax-particles have a ratio (a/b) of a major axis (a) to a minor axis (b) within the range between 1/1 and 3/1.

15. A toner of claim 13, in which the substantially spindle-shaped wax-particles have a ratio (a/b) of a mean major axis (a) to a mean minor axis (b) within the range between 20/1 and 5/1.

16. A toner of claim 13, in which the wax is contained at an amount of 1–7 parts by weight on the basis of the binder resin of 100 parts by weight.

17. A toner of claim 13, in which the number of substantially spindle-shaped wax-particles occupy 60% or less of the total number of wax-particles.

18. A toner of claim 13, having a mean toner-particle size between 3 and 15 μm.

19. A toner of claim 13, having a mean toner-particle size between 3 and 9 μm.

* * * * *